United States Patent [19]

Hull

[11] 4,004,833

[45] Jan. 25, 1977

[54] DOOR LOCK DEVICE

[76] Inventor: Howard L. Hull, 5752 Evanston St., Indianapolis, Ind. 46220

[22] Filed: Oct. 17, 1975

[21] Appl. No.: 623,444

[52] U.S. Cl. ..... 292/288

[51] Int. Cl.[2] ..... E05C 19/18

[58] Field of Search ..... 292/148, 258, 288, 205, 292/DIG. 2

[56] References Cited

UNITED STATES PATENTS

| | | | |
|---|---|---|---|
| 827,624 | 7/1906 | Foster | 292/288 |
| 1,239,802 | 9/1917 | Macbeth | 292/258 |
| 1,894,913 | 1/1933 | Sadler | 292/205 X |
| 2,536,352 | 1/1951 | Butcher | 292/148 |

*Primary Examiner*—Richard E. Moore

*Attorney, Agent, or Firm*—Woodard, Weikart, Emhardt & Naughton

[57] ABSTRACT

A lock bolt device which comprises a lock bolt received upon the shaft of a door knob and extending into an aperture in a retaining plate attached to the door jamb.

10 Claims, 4 Drawing Figures

DOOR LOCK DEVICE

BACKGROUND OF THE INVENTION

1. Field of the Invention

This device relates to apparatus attachable to a door for preventing the door from being opened.

2. Description of the Prior Art

A typical door is mounted in a door jamb with hinges which are attached to the mounting edge of the door. The door pivots along the mounting edge within the doorway defined by the door jamb. The door has an open position for permitting passage through the doorway and a closed position for prohibiting passage through the doorway.

The typical door incorporates a standard door latching assembly for maintaining the door in the closed position. The standard latching assembly usually includes a sliding bar which is operable to extend perpendicularly from the latching edge of the door, the latching edge generally being the edge opposite the mounting edge. In the latching position, the sliding bar extends from the latching edge into an aperture in a strike plate attached to the latching surface of the door jamb. The sliding bar may be connected to a door knob assembly having a shaft extending from one side of the door and a door knob attached to the shaft. The sliding bar is withdrawn from the aperture in the strike plate by rotation of the door knob and shaft.

To enable the door to be unlatched from either side, the door knob assembly can include a shaft and door knob extending from both sides of the door. The latching assembly can include a key lock or other locking system to prevent the door from being unlatched while the lock is engaged. The lock is engageable from the interior side of the door. Additionally, a key lock permits the door to be unlatched by the operation of a key from the exterior side of the door.

In many circumstances the standard door lock assembly is inadequate. Exterior key locks are susceptible to being opened by anyone having a master or skeleton key or by one skilled in the use of burglary tools. In certain circumstances, a person may have obtained an original or duplicate key for the lock. This is particularly true of a door lock for the door to an apartment, and can also be true for other doors. The problem of keys being in existence can be remedied by changing all of the door locks, but this is quite expensive, particularly if the change is intended to ensure security against only a very few persons. The general susceptibility of key locks to being opened is curable only by replacing or supplementing the existing locks with other devices.

Another familiar problem with the standard door latching assembly is the ease with which many of the sliding bars may be moved out of the strike plate aperture without operation of the door knob assembly. As a door is pivoted to the closed position, the sliding bar must pass across the strike plate on one side of the aperture. The sliding bar is normally held in the extended latching position. The sliding bar is therefore provided with a convex curved leading surface which first contacts the strike plate when the door is closed and which causes the bolt to be forced into the door until the door is fully closed. The sliding bar is then free to return to the extended position, and the sliding bar extends into the aperture in the strike plate latching the door. This curved leading surface thus facilitates closing and latching the door. However, it also facilitates opening the door by direct removal of the sliding bar from the aperture in the strike plate. This may be accomplished by insertion of a thin object such as a knife into the space between the latching edge of the door and the latching surface of the door jamb. Forcing this object against the sliding bar will force the sliding bar into the door and out of the aperture, in the same manner that the sliding bar is temporarily forced into the door when the door is closed.

Another problem with the standard door latching assembly, as well as other latching systems, is that they are easily released from inside the door. Although this feature makes such devices more convenient to use, it decreases their usefulness in some circumstances. The primary problem arises if the door includes or is located near a glass window. The glass may be easily broken and a hand reached in to disengage the latch.

In addition, a latch may be desired which can be used from the exterior of the doorway. It is obviously important then to have a device which cannot be disengaged without first disengaging a locking system operably connected with the latching assembly.

In recognition of the desirability of improved door latching systems, various door attachments have been devised. A door lock attachment should be effective, inexpensive, easily installed, and not damaging to the door or its surrounding structure. None of the present devices meet all of these criteria.

One type of device involves the operable attachment of additional sliding bars to the door knob assembly. Examples of these devices are disclosed in U.S. Pat. Nos. 1,172,846 issued to Swanson on Feb. 22, 1916; 1,240,403 issued to Amato on Sept. 18, 1917; and 2,188,532 issued to Dominguez on Sept. 24, 1938. Each of these devices incorporate two vertical sliding bars, one extending to the floor and the other extending to the door jamb above the door. These devices are notably expensive, difficult to install, and rather unsightly. Since they operate in conjunction with the standard door latching assembly, they also share equally its shortcomings.

A second type of device is exemplified by the apparatus claimed in U.S. Pat. No. 3,583,743 issued to Newell on June 8, 1971. The apparatus includes a vertical, adjustable-length member which engages the bottom of the shaft of the door knob assembly and the floor. Characteristic of this type of device, the Newell apparatus is relatively expensive, can be used only on the interior of the door, and must be modified for use with various floor coverings.

A third type of device involves a locking bolt which is attached to the door and passes through an aperture in a plate attached to the door jamb. Examples of this type of locking assembly are the chain lock having a bolt received in a channel attached to the door jamb, and a bolt which slides in a channel attached to the door and is received within an aperture in a retaining member located on the door jamb. In each of these devices, one or both of the locking elements is attached to the interior side of the door or door jamb, usually by screws. This results in the lock being only as strong as the screws which hold it in place. Frequently, it is one of the locking elements being dislodged from the door or door jamb which permits the door to be forced open. Further, these devices must be permanently affixed to the door and door jamb, and they may be disengaged by a hand reached through a nearby broken window.

Another device of this general type is disclosed in U.S. Pat. No. 1,239,882 issued to Macbeth on Sept. 11, 1917. This device incorporates a locking bolt having a hooked end extending around one side of the door knob shaft. The other end is passed through two holes in the retaining plate. This plate has gripping fingers which are shaped to be embedded in the door jamb when force is applied to the plate in the direction of the door. This force is applied by a wing nut which is threaded onto the end of the locking bolt which passes through the holes in the plate. When the nut is tightened against the portion of the plate forming the aperture farthest from the door, this exerts tension through the plate and the locking bolt to the door knob shaft and the gripping fingers. As the nut is tightened, the gripping fingers become embedded in the door jamb.

Like the previous locking devices discussed, this device has many undesirable aspects. Most significant is the manner in which the door is secured against being opened. When pressure is exerted to open the door, the force is fully borne by that portion of the door jamb engaged by the gripping fingers. The device is therefore initially limited to the strength of the door jamb material so engaged and the strength of the attachment of the jamb to the wall. The device would clearly be useless if the door jamb is merely a thin piece of wood nailed to the wall or if the door jamb were metal. Further disadvantages of this device include the damage done to the door jamb, the susceptibility of the device to being released by a hand reached through a nearby, broken window, and the needless expense and unsightliness of the design. The device is also not suited for use on the exterior of the door.

SUMMARY OF THE INVENTION

A door locking device is described herein comprising a door knob assembly including a knob attached to a shaft extending from a side of a door, a retaining plate attached to the door jamb, and a lock bolt having a first portion received upon the shaft and a second portion received within an aperture in the retaining plate. The retaining plate may be attached to the latching surface of the door jamb, the latching surface being that surface which faces the latching edge of the door.

The retaining plate can be substituted for the strike plate of a standard door latching assembly, and a second aperture is then formed in the retaining plate for receiving the sliding bar of the standard door latching assembly.

It is an object of this invention to provide a door lock device which is easily installed upon a door.

It is a further object of this invention to provide a door lock device which is simple in design and inexpensive to manufacture.

Another object of this invention is to provide a door lock device which may not be readily disengaged from the side of the door on which the device is located.

A further object of this invention is to provide a door lock device which may not be readily disengaged from the side of the door opposite the side on which the device is located.

Related objects and advantages of the present invention will be apparent from the following description.

DESCRIPTION OF THE PREFERRED EMBODIMENTS

Figure 1:
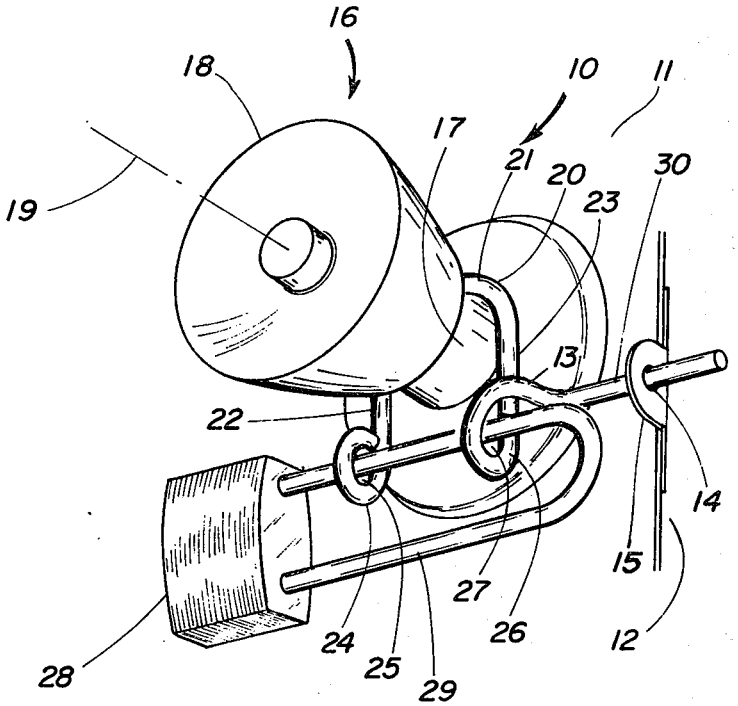
FIG. 1 is a perspective view of the door lock device.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring in particular to FIG. 1, there is shown a door lock device 10 according to the present invention. Door 11 is maintained in the closed position relative door jamb 12 by the action of lock bolt 13 received within a first aperture 14 of strike plate 15. Only a portion of the door jamb 12 is pictured. Door jamb 12 forms a doorway in which door 11 is positioned.

Door knob assembly 16 is mounted upon door 11. Door knob assembly 16 includes shaft 17 to which knob 18 is attached. Shaft 17 is rotatable around its horizontal axis, shown by line 19.

Lock bolt 13 is preferably made from a single piece of heavy wire material. This construction is simple and relatively inexpensive. Other embodiments could include separate elements operatively connected. These may be better suited to constructing unusually shaped lock bolts for doors or door knob assemblies of uncommon design.

Lock bolt 13 has a first section 20 positioned upon shaft 17. The first section 20 has an arcuate portion 21 complementary to shaft 17 and received thereon. First section 20 further comprises portions 22 and 23 which extend downwardly on either side of shaft 17.

Downwardly extending portion 22 terminates in a loop 24 which forms an aperture 25. Portion 23 similarly contains a loop 26 forming an aperture 27.

Lock 28 is shown with locking member 29 extending through apertures 25 and 27. In this position, the area defined by first section 20 and that portion of locking member 29 which extends between apertures 25 and 27 is less than the greatest cross-sectional area of knob 18. This prevents first section 20 from being removed from door knob apparatus 16 while locking member 29 is so positioned.

Lock bolt 13 also comprises a second section 30 which is received within a first aperture 14 of strike plate 15. Strike plate 15 is attached to door jamb 12 as is better shown in FIGS. 3 and 4.

Figure 2:
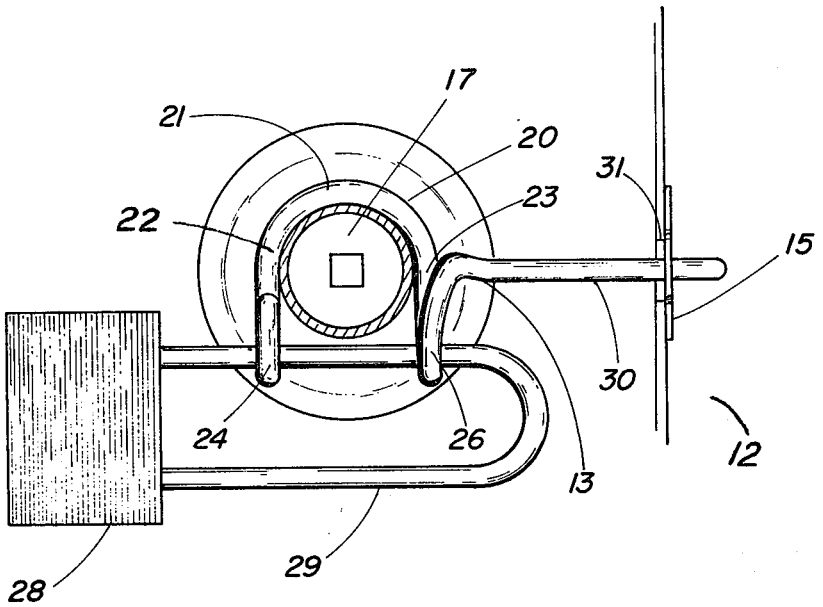
FIG. 2 is a front elevational view of the door lock device with the door knob removed.

Referring to FIG. 2, there is shown a front elevational view of the embodiment of FIG. 1 with the knob removed from the shaft of the door knob assembly.

Arcuate portion 21 of first section 20 is received upon shaft 17. Loops 24 and 26 are formed in downwardly extending portions 22 and 23, respectively.

Locking member 29 of lock 28 passes through the apertures in loops 24 and 26. It is clearly shown in FIG. 2 that the first element is thereby prevented from being removed from the door knob assembly when the knob is attached to the shaft. First section 20 is sized to have arcuate portion 21 and downwardly extending portions 22 and 23 lying at or near the surface of shaft 17. Loops 24 and 26 are formed below the bottom of shaft 17, but are positioned to have locking member 29 near or adjacent the bottom of shaft 17 when it is passed through the apertures in the loops. The knob 18 being larger than the shaft 17 presents a barrier to removal of first section 20 when the locking member 29 is in place.

It is not necessary that locking member 29 be positioned through the apertures in loops 24 and 26. In the preferred embodiment pictured in FIG. 2, it is clear that first element 20 will be maintained in place upon shaft 17 by the force of gravity. This design thus permits use of the door lock combination without any connection between loops 24 and 26. Further, a simple hook or other connecting device could be substituted for the lock 28. The lock 28 is important, however, if access to the door lock combination is available. By using the locking element 29 of a lock 28 to connect loops 24 and 26, the door lock combination is made secure against even a person having access to the apparatus. The locking combination can therefore be used on the exterior of a door or on a door having glass nearby which could be broken to enable a hand to be reached around to the interior door knob.

Second section 30 of lock bolt 13 is shown received within a first aperture in strike plate 15. Strike plate 15 is mounted upon door jamb 12. There is also shown a sliding bar 31 which is received within a second aperture in strike plate 15, this being more clearly shown in FIGS. 3 and 4.

Figure 3:
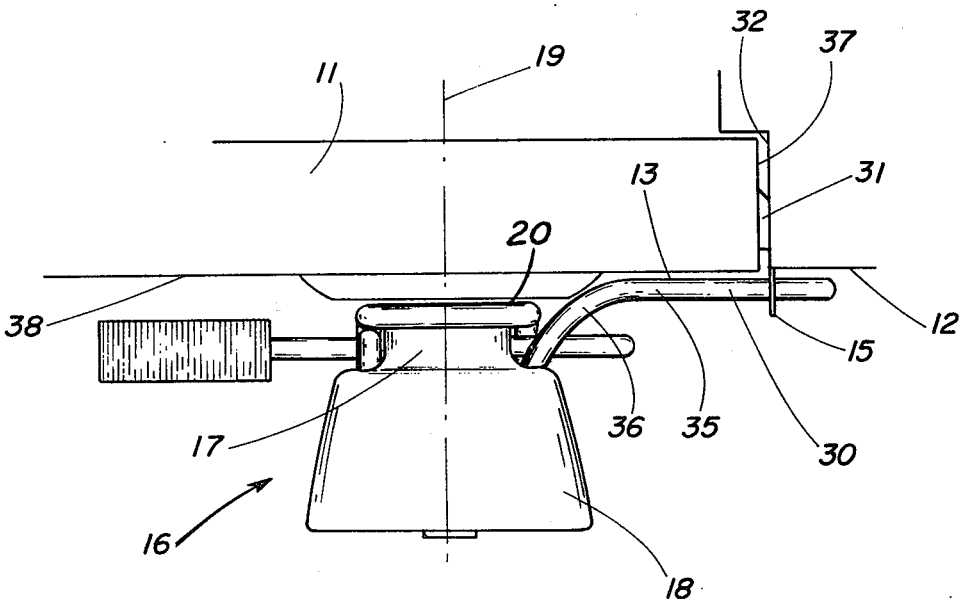
FIG. 3 is a top elevational view of the door lock device.

In FIG. 3, there is shown a top elevational view of the present embodiment of the invention. First section 20 is positioned on door knob assembly 16. Second element 30 is received within a first aperture in strike plate 15. Sliding bar 31 is connected to door knob assembly 16 and is received within a second aperture in strike plate 15. Sliding bar 31 is operable to be inserted and withdrawn from the second aperture when knob 18 and shaft 17 are rotated about horizontal axis 19.

Figure 4:
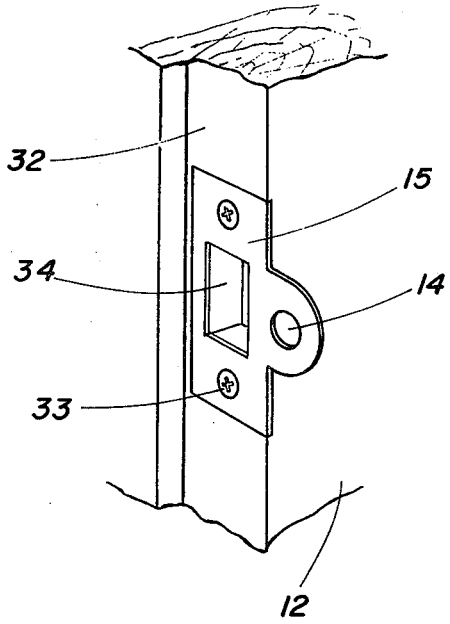
FIG. 4 is a perspective view of a retaining plate which may be utilized in the door lock device.

A strike plate which may be used in the present invention is shown in FIGS. 3 and 4. The plate is attached by screws such as 33 to latching surface 32 of door jamb 12. Surface 32 is parallel with and adjacent to edge surface 37 of door 11 when the door is closed.

Strike plate 15 has a first aperture 14 which receives the second section 30 of lock bolt 13. Sliding bar 31 is received within second aperture 34 of strike plate 15.

It is apparent from FIG. 3 that it does not matter how far surface 32 extends relative side 38 of door 11. If latching surface 32 does not extend beyond side 38, then first aperture 14 of strike plate 15 is located beyond the edge of latching surface 32. If latching surface 32 extends beyond side 38, then first aperture 14 will lie adjacent latching surface 32 and a hole in door jamb 12 will be required to receive that portion of second section 30 which extends through first aperture 14.

By locating strike plate 15 parallel to latching edge 37 of door 11, a superior lock combination is obtained. Force applied to open the door 11 is applied perpendicular to the screws such as 33 holding strike plate 15 to door jamb 12. This presents a shear force to the screws and a great force is required to dislodge strike plate 15.

As shown in FIG. 3, second section 30 of lock bolt 13 includes a portion 35 which lies adjacent the side 38 of door 11. Second section 30 further includes a second portion 36 which is angularly disposed from portion 35 and which connects it to first section 20. This design further ensures that the force exerted to open the door 11 will be applied parallel to surface 32 and perpendicular to second section 30. For standard door knob assemblies this feature is not crucial since a straight second section would be almost parallel with side 38 of door 11. This construction may be important, however, for use with some doors in which a straight lock bolt would lie at a substantial angle to the plane of side 38 of door 11.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. The combination comprising:

a door having two sides;

a door knob assembly mounted upon said door and comprising a shaft extending outwardly from one side of said door and having a horizontal axis, and a knob larger than said shaft and attached to said shaft;

a lock bolt having a first section extending downwardly on both sides of the shaft of said door knob assembly below the horizontal plane passing through the center of said shaft, and a second section extending from said first section; and a door jamb defining a doorway, said door being hingedly mounted in said door jamb and having an open and a closed position, said door having a latching edge and the door jamb having a latching surface adjacent the latching edge of said door when said door is in the closed position; and retaining means for engaging said lock bolt when said door is in the closed position, said retaining means including a strike plate attached to the latching surface of said door jamb, said strike plate having a first aperture in which the second section of said lock bolt is received;

said door knob assembly including a sliding bar operable to extend from the latching edge of said door, said strike plate additionally including a second aperture for receiving said sliding bar, said sliding bar having a first position in which it is received within the second aperture and a second position in which it is contained within said door.

2. The combination of claim 1 in which said first section of said lock bolt has a portion which is arcuate in shape, said arcuate portion being complementary with the shaft of the door knob assembly and being received thereon.

3. The combination of claim 1 in which said first section of said lock bolt extends downwardly on both sides of the shaft of said door knob assembly below a horizontal plane tangent to the lowest portion of said shaft, and which additionally comprises:

connecting means positioned between the downwardly extending portions of said first section and connected to each of the downwardly extending portions of the first section of the lock bolt for preventing said first element from being removed from said door knob assembly while said connecting means is engaged.

4. The combination comprising:

a door having two sides;

a door knob assembly mounted upon said door and comprising a shaft extending from one side of said door and having a horizontal axis, and a knob larger than said shaft and attached to said shaft;

retaining means having a first aperture for receiving a lock bolt;

a lock bolt having a first section extending downwardly on both sides of the shaft of said door knob assembly below a horizontal plane tangent to the lowest portion of said shaft, said downwardly extending portions of said first section having apertures formed therein at a point below a horizontal plane through the bottom of the shaft of the door knob assembly, said lock bolt further including a second section extending from said first section and being received within the first aperture in said retaining means; and connecting means positioned between the downwardly extending portions of said first section and connected to each of the downwardly extending portions of the first section of the lock bolt for preventing said first element from being removed from said door knob assembly while said connecting means is engaged, the connecting means including a member extending through said apertures in said downwardly extending portions.

5. The combination of claim 1 in which the lock bolt incorporates a single continuous length of material having an essentially constant cross-section and extending the entire length of the lock bolt and downwardly on each side of said shaft.

6. The combination of claim 4 in which the lock bolt incorporates a single continuous length of material having an essentially constant cross-section and extending the entire length of the lock bolt and downwardly on each side of said shaft and forming loops to provide said apertures.

7. The combination of claim 1 in which a portion of the second section of said lock bolt lies adjacent and parallel to the side of the door from which the shaft of the door knob assembly extends.

8. The combination of claim 4 in which the connecting means comprises a lock including a locking member sized to fit through the apertures of the downwardly extending portions of the first section of said lock bolt, said lock having a locked position in which said locking member passes through the apertures and prohibits removal of the first section of said lock bolt from said door knob assembly, and said lock having an unlocked position permitting said locking member to be withdrawn from the apertures and permitting removal of the first section from said door knob assembly.

9. In a combination for positively locking a door, said door being hingedly mounted in a door jamb and having an open and a closed position, said door including door knob means for moving a sliding bar into and out of a first aperture in a strike plate mounted in the door jamb, said door knob means including a shaft extending from a side of said door and a knob larger than said shaft and attached to said shaft, the improvement comprising:

said strike plate defining a second aperture located outside the plane of said door in the closed position; and a lock bolt having a first section extending downwardly on both sides of the shaft of said door knob assembly below the horizontal plane passing through the center of said shaft, and a second section extending from said first section and being received within the second aperture in said retaining means.

10. The combination comprising:

a door having two sides;

a door knob assembly mounted upon said door and comprising a shaft having a first portion which extends outwardly from one side of said door and having a horizontal axis, and a knob larger than said shaft and attached to said shaft;

retaining means for receiving a lock bolt, said retaining means including a plate defining an aperture, a door jamb, said door being hingedly mounted within said door jamb and having an open and a closed position, said door jamb including a latching surface lying within a plane which extends parallel to the shaft of said door knob assembly; and a lock bolt having a first section extending downwardly on both sides of the first portion of the shaft of said door knob assembly below the horizontal plane passing through the center of said shaft, and a second section extending from said first section and being received within the aperture defined by the plate of said retaining means, the plate being mounted upon the latching surface of said door jamb, said lock bolt and the aperture in the plate being disposed outside of the plane of said door in the closed position.

* * * * *